US008712313B2

(12) United States Patent
Kim et al.

(10) Patent No.: US 8,712,313 B2
(45) Date of Patent: Apr. 29, 2014

(54) IMAGE FORMING APPARATUS

(75) Inventors: Tae Hoon Kim, Yongin-si (KR); Jae Hyeok Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 502 days.

(21) Appl. No.: 12/603,170

(22) Filed: Oct. 21, 2009

(65) Prior Publication Data

US 2010/0143014 A1 Jun. 10, 2010

(30) Foreign Application Priority Data

Dec. 4, 2008 (KR) ..... 10-2008-0122268

(51) Int. Cl.
*G03G 15/00* (2006.01)
*B65H 29/70* (2006.01)

(52) U.S. Cl.
USPC ..... 399/406; 271/161

(58) Field of Classification Search
USPC ..... 399/406; 271/161
IPC ..... B65H 29/70
See application file for complete search history.

(56) References Cited

U.S. PATENT DOCUMENTS

| | | | | |
|---|---|---|---|---|
| 3,850,520 | A * | 11/1974 | Washio et al. | 399/209 |
| 5,059,988 | A * | 10/1991 | Hisada | 346/134 |
| 5,920,759 | A * | 7/1999 | Ushiroji et al. | 399/406 |
| 7,298,981 | B2 * | 11/2007 | Oohara et al. | 399/45 |
| 2001/0033762 | A1 * | 10/2001 | Nishio | 399/406 |
| 2003/0185610 | A1 * | 10/2003 | Jeong | 399/401 |
| 2008/0008480 | A1 * | 1/2008 | Momose et al. | 399/23 |
| 2008/0038031 | A1 * | 2/2008 | Koshida | 399/406 |
| 2008/0310900 | A1 * | 12/2008 | Lee | 399/406 |
| 2011/0236102 | A1 * | 9/2011 | Furushige et al. | 399/406 |

FOREIGN PATENT DOCUMENTS

| | | | | |
|---|---|---|---|---|
| JP | 01209268 | A * | 8/1989 | H65H 29/70 |
| JP | 02116578 | A * | 5/1990 | B41J 15/04 |
| JP | 04021476 | A * | 1/1992 | G03G 15/00 |
| JP | 04032456 | A * | 2/1992 | G03G 15/00 |
| JP | 04116052 | A * | 4/1992 | B65H 23/34 |
| JP | 04243760 | A * | 8/1992 | B65H 23/34 |
| JP | 06098078 | A * | 4/1994 | B65H 23/34 |
| JP | 08225219 | A * | 9/1996 | G03G 15/00 |
| JP | 10025039 | A * | 1/1998 | G03G 15/00 |
| JP | 2000169050 | A * | 6/2000 | G03G 15/00 |
| JP | 2000177906 | A * | 6/2000 | B65H 29/70 |
| JP | 2005060016 | A * | 3/2005 | B65H 23/34 |

(Continued)

OTHER PUBLICATIONS

Machine Translation of JP 10025039 A, JPO, Apr. 4, 2012.*

(Continued)

*Primary Examiner* — Nguyen Ha
(74) *Attorney, Agent, or Firm* — Stanzione & Kim, LLP

(57) ABSTRACT

Disclosed herein is an image forming apparatus. The image forming apparatus includes a fixing device configured to fix a visible image transferred on a printing medium, a decurl device configured to correct a curl produced on the printing medium, a discharging device configured to discharge the printing medium to a space outside of a main body of the image forming apparatus, and a guide device disposed between the fixing device and the discharging device. The guide device guides the printing medium around the decurl device when a transport direction of the printing medium is reversed for duplex printing.

22 Claims, 11 Drawing Sheets

(56) References Cited

FOREIGN PATENT DOCUMENTS

| | | | | | |
|---|---|---|---|---|---|
| JP | 2006208729 | A | * | 8/2006 | ..... B65H 29/70 |
| JP | 2008050086 | A | * | 3/2008 | ..... B65H 29/70 |
| JP | 2008-094507 | | | 4/2008 | |
| JP | 2008222427 | A | * | 9/2008 | ..... B65H 29/70 |

OTHER PUBLICATIONS

English language abstract of JP 2008-094507, published Apr. 24, 2008.

Machine English language translation of JP 2008-094507, published Apr. 24, 2008.

* cited by examiner

IMAGE FORMING APPARATUS

CROSS-REFERENCE TO RELATED APPLICATION

This application claims the benefit of Korean Patent Application No. 10-2008-00122268, filed on Dec. 4, 2008 in the Korean Intellectual Property Office, the disclosure of which is incorporated herein by reference in its entirety.

TECHNICAL FIELD

The present disclosure relates generally to an image forming apparatus, and more particularly, to an image forming apparatus with printing media curl correction capability.

BACKGROUND OF RELATED ART

An image forming apparatus typically refers to an apparatus configured to form an image on a printing medium in accordance with an input signal. Examples of image forming apparatuses include printers, photocopiers, facsimiles, and multifunction devices that integrate or combine some of the functions of such apparatuses.

An electro-photographic image forming apparatus, which is a type of the image forming apparatus, can produce an image on a printing medium by using the following general processes. A surface of a photoconductive medium is charged to a predetermined electrical potential. A light having information corresponding to image data is made incident upon the charged photoconductive medium to form an electrostatic latent image on the surface of the photoconductive medium. Developer is applied to the electrostatic latent image to form a visible image. The visible image on the photoconductive medium can be transferred to a printing medium directly or indirectly through an intermediate transfer unit. The transferred visible image can be fixed on the printing medium by using a fixing process.

Typically, the printing medium, which is initially flat, can become curled during the fixing process because of the high heat and pressure used during the process. The curled printing medium may be passed between two discharging rollers having different solidities in an attempt to correct the curling.

SUMMARY OF THE DISCLOSURE

In accordance with one aspect of the present disclosure, there is provided an image forming apparatus that can include a main body, a photoconductive medium disposed in the main body, charging device configured to charge the photoconductive medium to a predetermined electrical potential, a scanning device configured to scan the charged photoconductive medium with light corresponding to image data to form an electrostatic latent image on the photoconductive medium, a developing device configured to form a visible image on the photoconductive medium by supplying a developer to the photoconductive medium, a transfer device configured to transfer the visible image from the photoconductive medium to a printing medium, a fixing device configured to fix the visible image on the printing medium, a decurl device configured to correct a curl produced on the printing medium when the printing medium passes through the fixing device, a discharging device configured to discharge the printing medium outside of the main body, and a guide device disposed between the fixing device and the discharging device, and configured to guide the printing medium around the decurl device when a transport direction of the printing medium is reversed for duplex printing.

The guide device can be pivotably connected to the main body.

The guide device can be configured to be selectively pivoted between a first position and a second position, in the first position the guide device is configured to allow the printing medium to be fed to the discharging device from the decurl device, in the second position the guide device is configured to guide the printing medium around the decurl device when the transport direction of the printing medium is reversed for duplex printing.

An initial position of the guide device can be the second position. The guide device can be configured to pivot to the first position from the initial position when the printing medium is discharged from the decurl device, the guide device being configured to return to the initial position from the first position by its own weight after the printing medium is passed through the decurl device.

The image forming apparatus can further include a member configured to elastically bias the guide device toward the initial position.

The image forming apparatus can further include an actuator configured to pivot the guide device.

The decurl device can include a decurl roller and a curved member defining a decurl path having a predetermined curvature associated with a curvature of the decurl roller.

The decurl device can include a first decurl roller and a second decurl roller disposed opposite the first decurl roller, wherein each of the first decurl roller and the second decurl roller is rotatably disposed in the decurl device.

The decurl device can also include a curved member configured to guide the printing medium through the first decurl roller and the second decurl roller of the decurl device.

The guide device can include a curved portion.

The curved portion of the guide device can be configured to curve around the decurl device.

In accordance with another aspect of the present disclosure, there is provided an image forming apparatus that can include a main body, a printing device disposed in the main body and configured to form a visible image corresponding to image data on a printing medium, a decurl device configured to correct a curl on the printing medium, and a guide device disposed along a reverse-direction transport path and configured to guide the printing medium around the decurl device.

The printing device can include a photoconductive medium, a charging device configured to charge the photoconductive medium to a predetermined electrical potential, a scanning device configured to scan the charged photoconductive medium with light corresponding to image data to form an electrostatic latent image on the photoconductive medium, a developing device configured to form a visible image on the photoconductive medium by supplying a developer to the photoconductive medium, a transfer device configured to transfer the visible image from the photoconductive medium to a printing medium, and a fixing device configured to fix the visible image on the printing medium.

The guide device can be configured to be pivoted to selectively prevent the printing medium from passing through the decurl device.

The guide device can be configured to pivot from a first position to a second position when the printing medium is discharged from the decurl device such that an opening is formed at the decurl device through which the printing medium is discharged, the guide device being configured to return to the first position from the second by its own weight after the printing medium is discharged from the decurl device.

The decurl device can include a decurl roller and a curved member defining a decurl path having a predetermined curvature associated with a curvature of the decurl roller.

The guide device can include a curved portion configured to curve around the decurl device.

The image forming apparatus can further include a discharging device configured to discharge the printing medium to a space outside of the main body and the decurl device can be configured such that the printing medium is conveyed from the printing device to the discharging device through the decurl device, the guide device can be configured such that the printing medium curves around the decurl device when a transport direction of the printing medium is reversed for duplex printing.

In accordance with another aspect of the present disclosure, there is provided an image forming apparatus that can include a main body, a photoconductive medium disposed in the main body, a charging device configured to charge the photoconductive medium to a predetermined electrical potential, a scanning device configured to scan the charged photoconductive medium with light corresponding to image data to form an electrostatic latent image, a developing device configured to form a visible image on the photoconductive medium by supplying a developer to the photoconductive medium having the electrostatic latent image, a transfer device configured to transfer the visible image from the photoconductive medium to a printing medium, a fixing device configured to fix the visible image on the printing medium, a decurl device configured to correct a curl on the printing medium, a discharging device configured to discharge the printing medium to a space outside of the main body, and a guide device disposed between the decurl device and the discharging device and configured to prevent the printing medium from interacting with the decurl device when a transport direction of the printing medium is reversed for duplex printing.

In accordance with yet another aspect of the present disclosure, there is provided an image forming apparatus that can include a first device, a second device, a third device and a fourth device. The first device may be configured to fix an image on a printing medium. The second device may be configured to discharge the printing medium to a space outside the image forming apparatus. The third device may be disposed between the first device and the second device, and may be configured to remove at least a portion of a curl of the printing medium as the printing medium moves along a first direction away from the first device and toward the second device. The fourth device may be configured to guide the printing medium away from the third device when the printing medium moves along a second direction away from the second device.

The fourth device can be configured to have a first position and a second position, the fourth device being in the first position when the printing medium is passing through the third device in the first direction. The fourth device may be in the second position when the printing medium is moving in the second direction.

The fourth device can be configured to be in the first position or in the second position by pivoting about an end portion of the fourth device.

BRIEF DESCRIPTION OF THE DRAWINGS

Various aspects and advantages of the disclosure will become apparent and more readily appreciated from the following description of the embodiments, taken in conjunction with the accompanying drawings, in which.

DETAILED DESCRIPTION OF SEVERAL EMBODIMENTS

Figure 1:
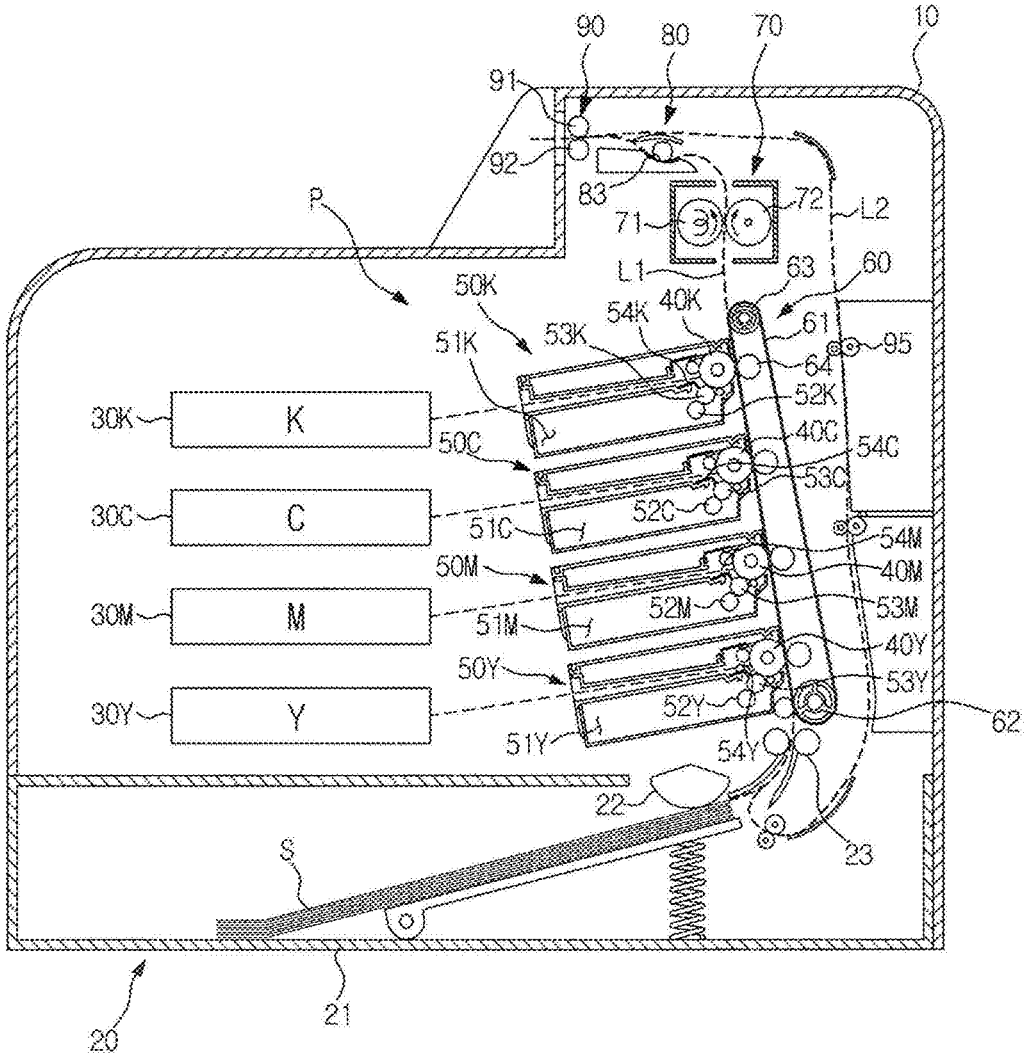
FIG. 1 is a sectional view of an image forming apparatus according to an embodiment of the present disclosure.

References will now be made to several embodiments of the present disclosure, examples of which are illustrated in the accompanying drawings, wherein like reference numerals refer to the like elements throughout.

FIG. 1 is a sectional view of an image forming apparatus according to an embodiment of the present disclosure.

As shown in FIG. 1, the image forming apparatus can include a main body 10, a printing medium feeding device 20, a printing unit P, a decurl unit 80 and a discharging device 90. The printing unit P can include laser scanning units 30K, 30C, 30M and 30Y, photoconductive mediums 40K, 40C, 40M and 40Y, developing devices 50K, 50C, 50M and 50Y, a transfer device 60, and a fixing device 70. The printing unit P can be configured to print an image in accordance with image data on printing medium supplied from the printing medium feeding device 20.

The main body 10 may define the external appearance of the image forming apparatus, and can support therein various components or devices of the image forming apparatus.

The printing medium feeding device 20 can include a cassette 21 configured to store the printing medium S, a pickup roller 22 configured to pick up the printing medium S stored in the cassette 21 and a feeding roller 23 configured to supply the picked up printing medium S to the transfer device 60. The pickup roller 22 may typically be constructed so as to pick up the printing medium S one sheet at a time.

Each of the laser scanning units 30K, 30C, 30M and 30Y can be configured to emit light corresponding to image data to a respective one of the photoconductive mediums 40K, 40C, 40M, and 40Y to form an electrostatic latent image on surfaces of the photoconductive mediums 40K, 40C, 40M, and 40Y. The light emitted by each of the scanning units can correspond to a portion of the color information included in the image data. For example, the light emitted by the scanning unit 30K can correspond to black (K) portions of the image data, the light emitted by the scanning unit 30C can correspond to cyan (C) portions of the image data, the light emitted by the scanning unit 30M can correspond to magenta (M) portions of the image data, and light emitted by the scanning unit 30Y can correspond to yellow (Y) portions of the image data.

Before being scanned with the light from the laser scanning units 30K, 30C, 30M, and 30Y, the photoconductive mediums 40K, 40C, 40M, and 40Y can be charged to predetermined potentials by charging devices, such as, for example, charging rollers (not shown). As described above, the electrostatic latent images are formed on the surfaces of the photoconductive mediums 40K, 40C, 40M and 40Y when light produced by the laser scanning units 30K, 30C, 30M and 30Y is scanned on those surfaces.

The developing devices 50K, 50C, 50M and 50Y can be used to form visible images by supplying developer to the electrostatic latent images formed on the surface of the associated photoconductive mediums 40K, 40C, 40M and 40Y. The developing devices 50K, 50C, 50M and 50Y can include developer storages 51K, 51C, 51M and 51Y, supplying rollers 52K, 52C, 52M and 52Y, and developing rollers 53K, 53C, 53M and 53Y, respectively. The developer storages 51K, 51C, 51M and 51Y can be configured to store developers of respective different colors, for example, black, cyan, magenta and yellow developers, to be supplied to the photoconductive mediums 40K, 40C, 40M and 40Y. The supplying rollers 52K, 52C, 52M and 52Y can be configured to supply the developers stored in the developer storages 51K, 51C, 51M and 51Y to the respective developing rollers 53K, 53C, 53M and 53Y. The black, cyan, magenta and yellow developers supplied to the developing rollers 51K, 51C, 51M and 51Y can be attached to the respective one of photoconductive mediums 40K, 40C, 40M and 40Y to form the visible images. Moreover, controlling members 54K, 54C, 54M and 54Y may be provided to control a thickness of the developers attached to the developing rollers 53K, 53C, 53M and 53Y.

The transfer device 60 can include a paper feeding belt 61, a driving roller 62 and a driven roller 63. Multiple transfer rollers 64 can be provided within the paper feeding belt 61. The transfer rollers 64 can be disposed opposite the respective photoconductive mediums 40K, 40C, 40M and 40Y, and can be configured to transfer the developers on the photoconductive mediums 40K, 40C, 40M and 40Y to the printing medium.

The fixing device 70 can include a pressing roller 72 and a heating roller 71 having a heating source, such as, for example, a halogen lamp, or the like. The printing medium upon which the visible image is transferred can be passed between the heating roller 71 and the pressing roller 72 so that the visible image can be fixed onto the printing medium by heat and pressure.

The decurl unit 80 is configured to correct a curl produced on the printing medium when the printing medium passes through the fixing device 70. The decurl unit 80 can include a decurl roller 81 and a curved member 82. A decurl path 83 can be formed by the decurl roller 81 and the curved member 82, and can be configured to have a predetermined curvature. The curvature of the decurl path 83 can be opposite in direction to the curl of the printing medium that enters the decurl unit 80. Thus, the curl of the printing medium can be corrected to be substantially flat by the decurl path 83 of the decurl unit 80. According to one embodiment, an outer circumferential portion of the decurl roller 81 can be made out of a soft sponge. The decurl path 83 may be thought of as part of the feeding path L1, which is explained below.

The discharging device 90 can be configured to discharge the printing medium to a space outside of the main body 10. The discharging device 90 can include a discharging roller 91 and a backup roller 92. Because the image forming apparatus can be configured to provide duplex printing, when the duplex printing process is performed, the printing medium can be reversed toward the inner portion of the main body 10 after reaching the discharging device 90. Therefore, with a leading end and a following end of the printing medium being inverted, the reversed printing medium can be conveyed and/or guided by multiple reversing rollers 95 back into the printing unit P. L2 in FIG. 1 illustrates a reverse path along which the printing medium is fed from the discharging device 90 back to the printing unit P during a duplex printing operation.

According to one or more embodiments of the present disclosure, the image forming apparatus can further include a guide unit 100 configured to prevent interaction between the decurl unit 80 and the printing medium when the printing medium has been reversed at the discharging device 90 for duplex printing. The guide unit 100 will now be explained in greater detail.

Figure 2:
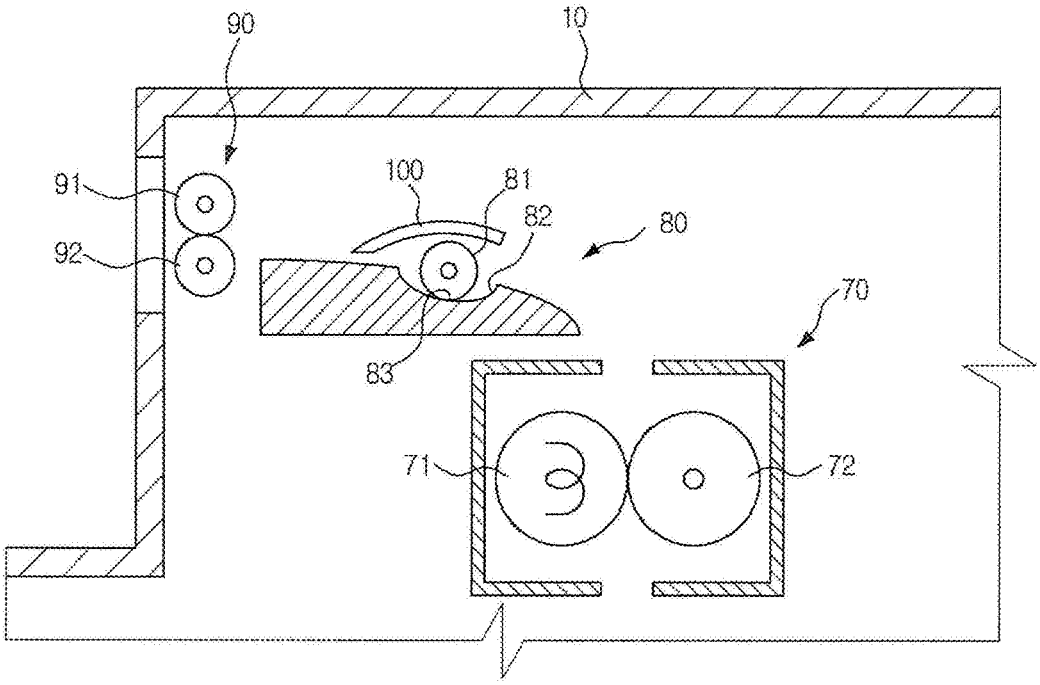
FIG. 2 is a sectional view showing a fixing device, a decurl unit, a discharging device and a guide unit of the image forming apparatus according to an embodiment.
Figure 3A:
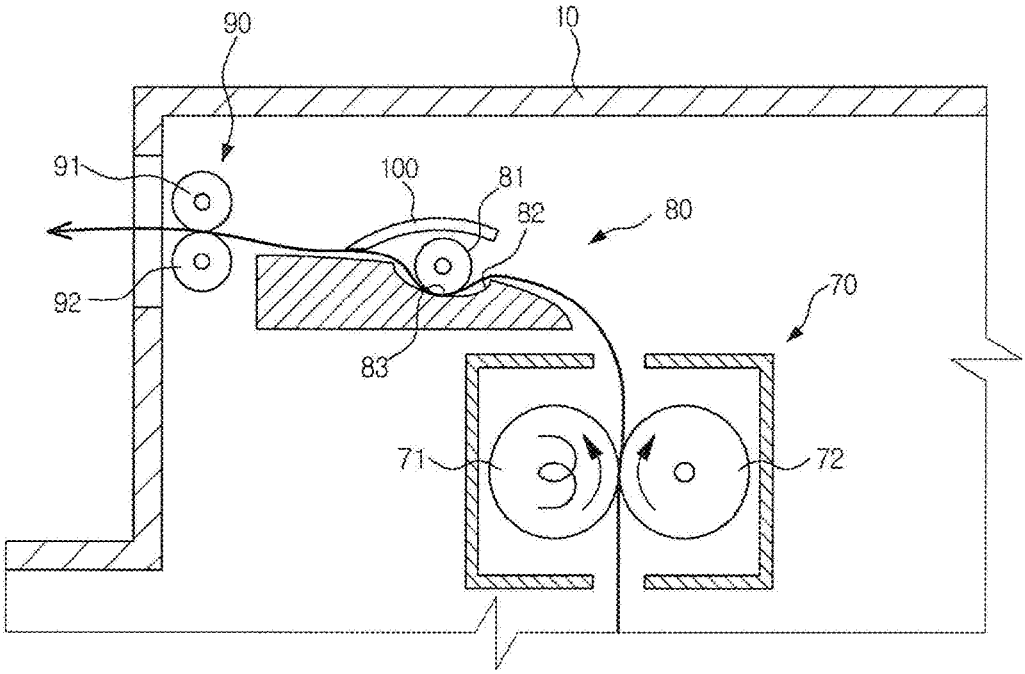
FIG. 3A and FIG. 3B are views respectively showing forward feeding and reverse feeding of a printing medium in the image forming apparatus according to an embodiment.
Figure 3B:
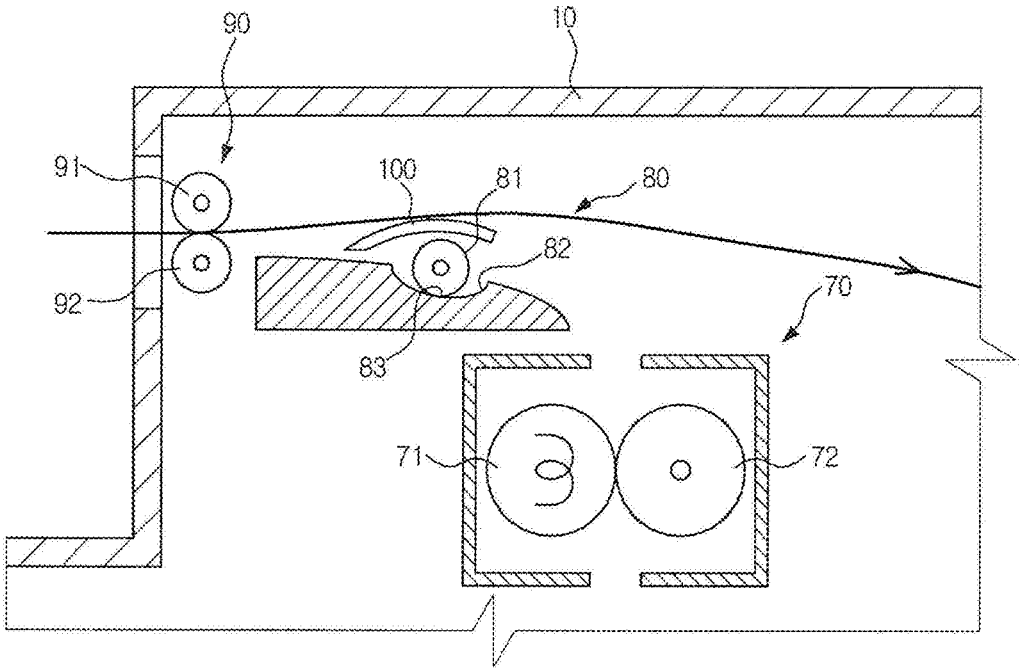

FIG. 2 is a sectional view showing the fixing device 70, the decurl unit 80, the discharging device 90, and the guide unit 100 in an image forming apparatus according to an embodiment of the present disclosure. FIG. 3A and FIG. 3B are views showing, respectively, forward feeding and reverse feeding of the printing medium in the image forming apparatus.

As shown in FIG. 2, the guide unit 100 can be disposed after (e.g., downstream of) the decurl unit 80 along the feeding path L1 for the printing medium. To facilitate an appropriate reverse feeding of the printing medium to the printing unit P, the guide unit 100 can have a predetermined curvature that corresponds to the reverse feeding path L2. For example, in the example shown in FIG. 2, the curvature of the guide unit 100 can be such that the guide unit 100 can enclose or curve around the decurl unit 80 so that when the transport direction of the printing medium is reversed, the printing medium can detour around or circumvent the decurl unit 80 near the decurl unit 80 without having to make an abrupt directional change along the reverse path.

As shown in FIG. 3A, the printing medium can enter the decurl unit 80 after passing through the fixing unit 70, which applies heat and pressure to the printing medium. As shown in FIG. 3B, for duplex printing, the transport direction of the printing medium can be reversed and the printing medium can detour around the decurl unit 80 being guided by the guide unit 100. Therefore, an interaction between the printing medium when reversed for duplex printing and the decurl unit 80 can be prevented by the guide unit 100. More specifically, when the printing medium is sent back in the direction of the decurl unit 80 after having passed through the decurl unit 80 and the discharging device 90 in the forward direction, the printing medium can be prevented by the guide unit 100 from entering the decurl path 83 of the decurl unit 80 or from interacting with the decurl roller 81 of the decurl unit 80.

As described above, because the decurl unit 80 is disposed between the fixing device 70 and the discharging device 90, the printing medium can be decurled by the decurl unit 80 after passing through the fixing device 70, but before being cooled. Thus, the curl correction efficiency can be improved.

In image forming apparatuses known heretofore that performs a curl correction, such curl correction is performed by the discharging device. In view of the aforementioned efficiency of the de-curling in relation to the distance from the fixing device to the location of the de-curling operation, such discharging device needs to be placed in sufficiently close proximity to the fixing device. However, when the distance between the fixing device and the discharging device becomes too short, it may become difficult to facilitate a reverse feeding of the printing medium as there may not be sufficient room to reverse the feeding direction of the printing medium, and the printing medium may thus be already discharged before having had a chance to reverse course to be sent back in the reverse path. According an aspect of the present disclosure, a sufficient feeding distance between the fixing device 70 and the discharging device 90 can be provided so that the reliability of paper feeding can be improved while ensuring a sufficient efficiency in the curl correction.

In addition, according to an aspect of the present disclosure, notwithstanding the decurl unit 80 being positioned between the fixing device 70 and the discharging device 90, the guide unit 100 can be used to form or define a portion of the reverse path L2 from the discharging device 90 to be directed adjacent the decurl unit 80. Therefore, the length of the reverse path L2 can be minimized, resulting in an improvement in the efficiency of the inner space of the image forming apparatus, and enabling a more compact image forming apparatus. That is, owing to the guide unit 100, the reverse feeding of the printing medium can be performed without the necessity of an abrupt change in direction and/or a significant elongating of the reverse path L2.

Figure 4:
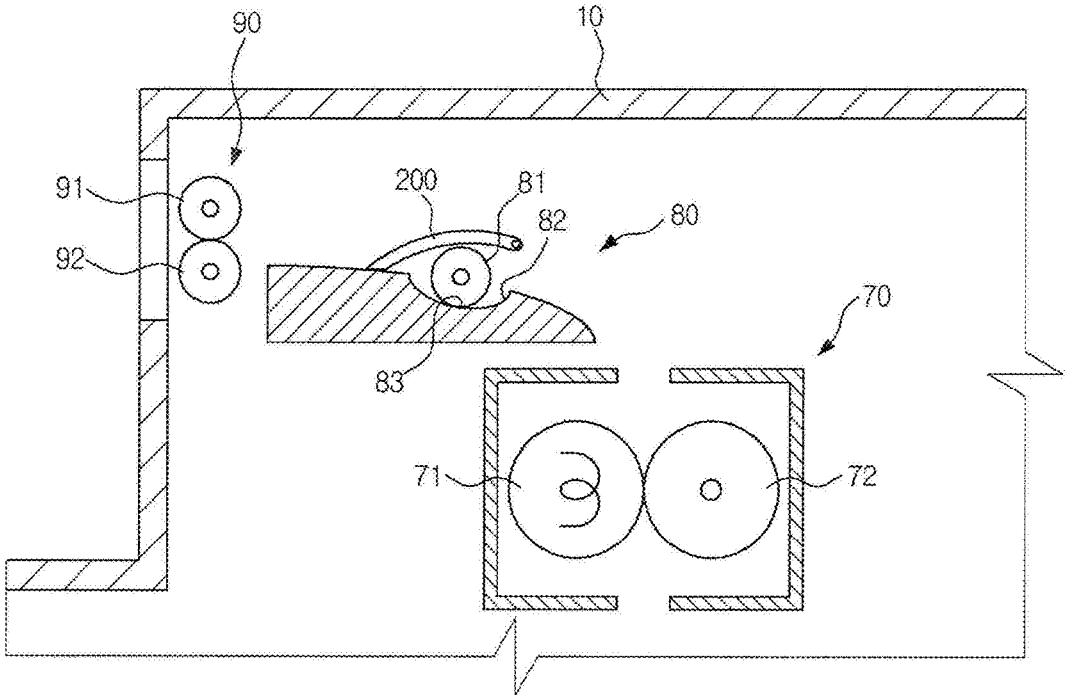
FIG. 4 is a sectional view showing a fixing device, a decurl unit, a discharging device and a guide unit of an image forming apparatus according to another embodiment of the present disclosure.
Figure 5A:
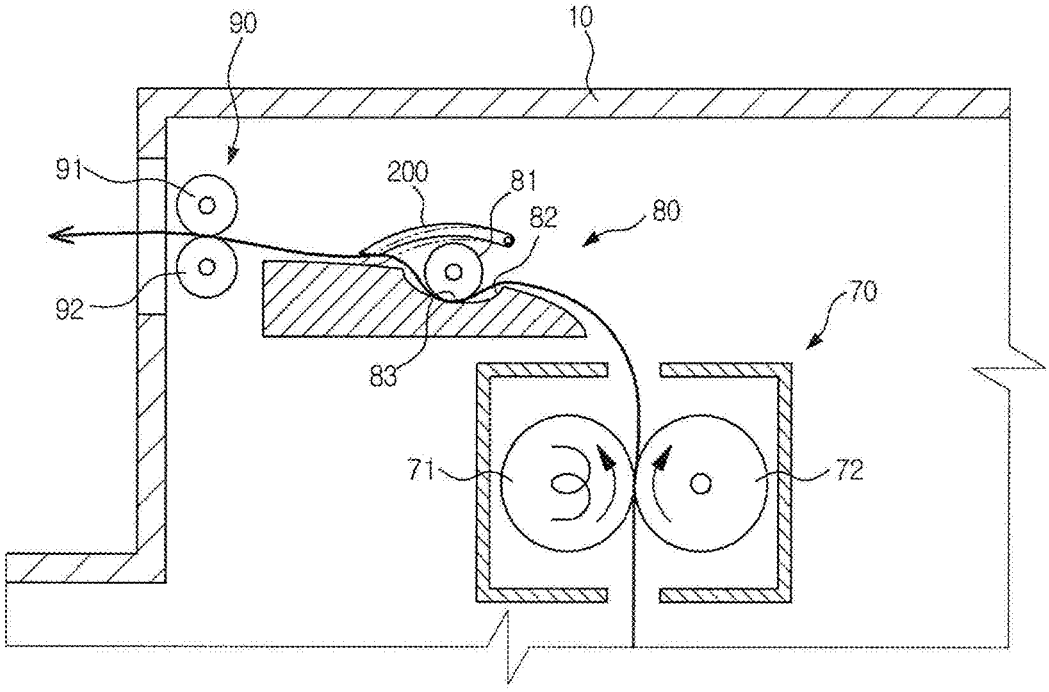
FIG. 5A and FIG. 5B are views respectively showing forward feeding and reverse feeding of a printing medium in the image forming apparatus according to an embodiment.
Figure 5B:
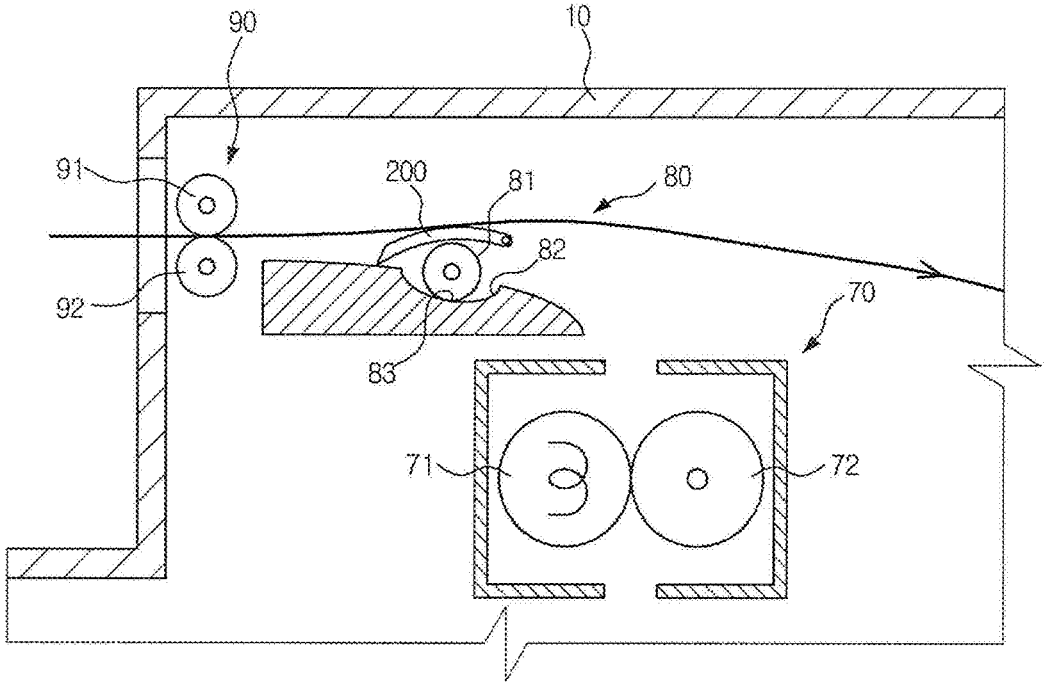
Figure 6:
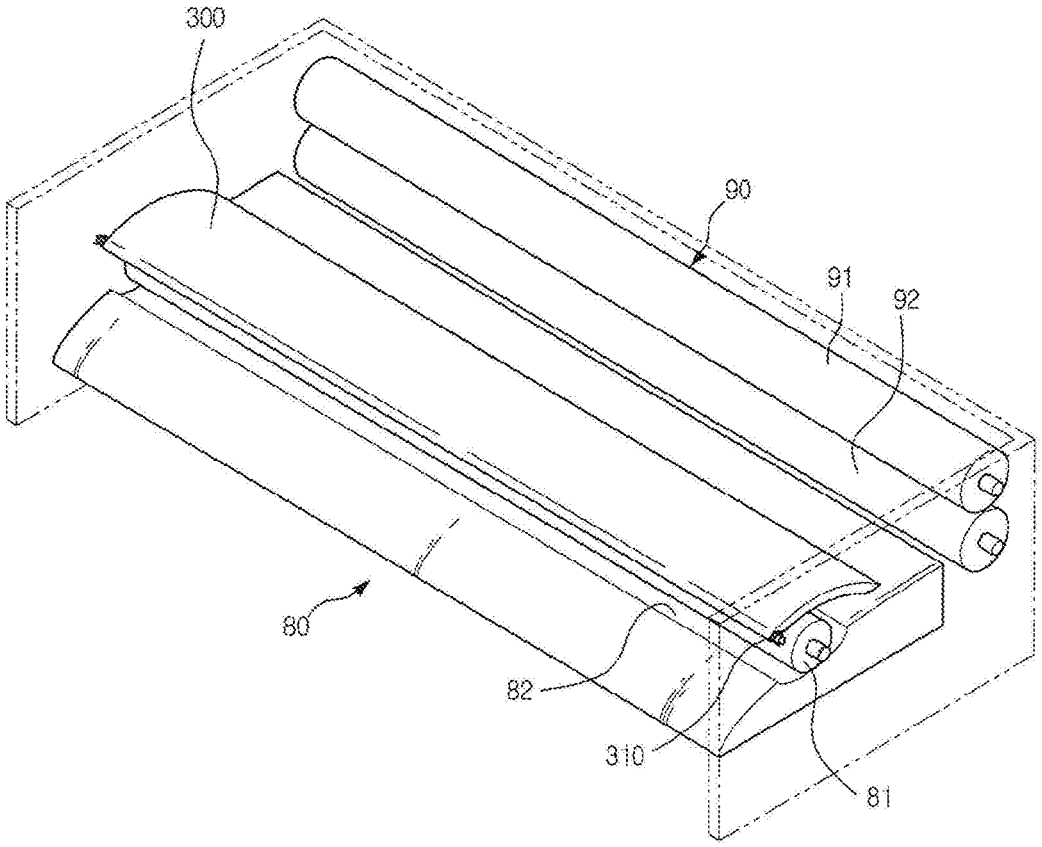
FIG. 6 is a perspective view showing a guide unit of an image forming apparatus according to an embodiment of the present disclosure.
Figure 7:
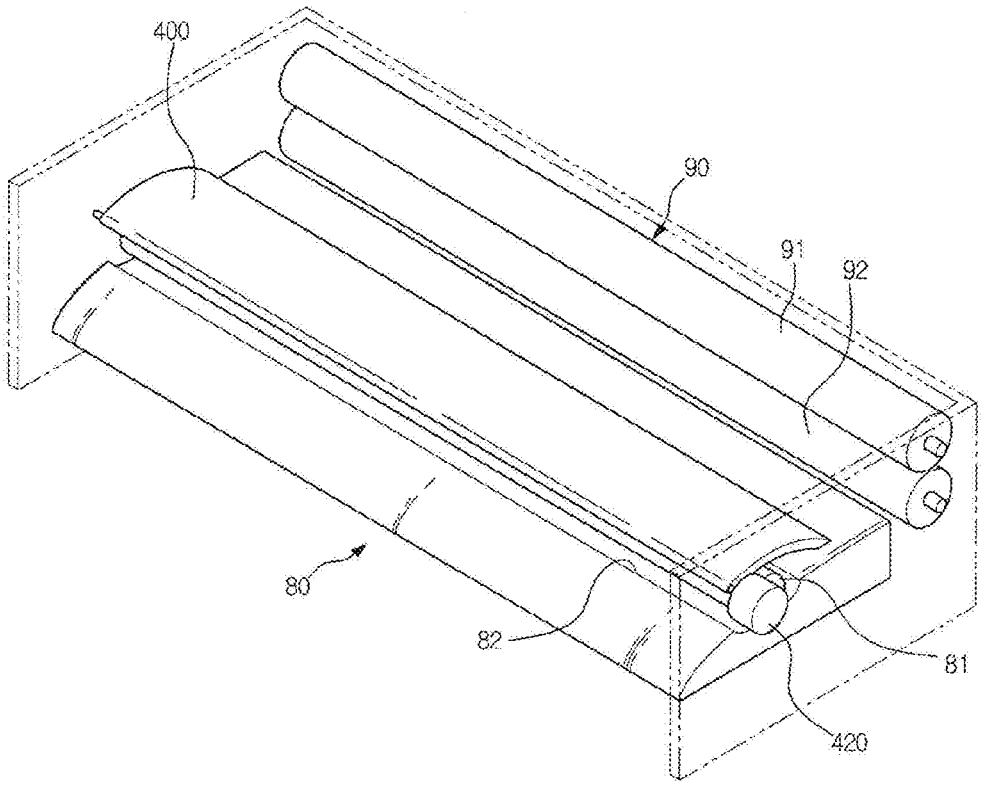
FIG. 7 is a perspective view showing a guide unit of image forming apparatuses according to another embodiment of the present disclosure.

FIG. 4 is a sectional view showing the fixing device 70, the decurl unit 80, the discharging device 90 and the guide unit 200 of an image forming apparatus according to another embodiment of the present disclosure. FIG. 5A and FIG. 5B are views showing forward feeding and reverse feeding, respectively, of the printing medium in the image forming apparatus. FIG. 6 and FIG. 7 are perspective views of the guide unit 100 of an image forming apparatus according to other embodiments of the present disclosure.

In the following description, structures and elements that are substantially similar to those previously described are referred to by the same reference numerals, and may not be repeatedly described.

As shown in FIG. 4, a guide unit 200 according to an embodiment can be pivotably connected to the main body 10 so as to selectively close the feeding path of the printing medium, that is, the decurl path 83. For example, the guide unit 200 can be pivoted from an initially closed position to an open position by the printing medium as the printing medium passes through the decurl path 83 so as to allow the exiting of the printing medium from the decurl unit 80. The guide unit 200 can be returned to the initial position by its own weight after the printing medium has passed through the decurl unit 80, thereby closing the decurl path 83 from the printing medium fed back along the reverse path L2.

More specifically, as shown in FIG. 5A, when the printing medium is being discharged from the decurl unit 80, the guide unit 200 can be pivoted by the printing medium allowing the printing medium to discharge. After the printing medium has passed through the guide unit 200, the guide unit 200 returns to the initial position by its own weight closing the decurl path 83 from entry in the reverse direction. As shown in FIG. 5B, during the reverse feeding from the discharging device 90 for duplex printing, the printing medium can slide above the guide unit 200 while the decurl path 83 remains closed by the guide unit 200.

As a result, when the transport direction of the printing medium is reversed, the reverse traveling printing medium can be prevented from entering the decurl path 83.

According to an another embodiment, a guide unit 300 as shown in FIG. 6 can include a resilient member 310 configured to elastically bias the guide unit 300 in one direction or toward a position. Referring to FIG. 7, a guide unit 400 according to yet another embodiment can include an actuator 420 configured to pivot the guide unit 400.

In addition to the above-described embodiments, other various configurations of the guide unit may be employed consistently with one or more aspects of the present disclosure.

Figure 8A:
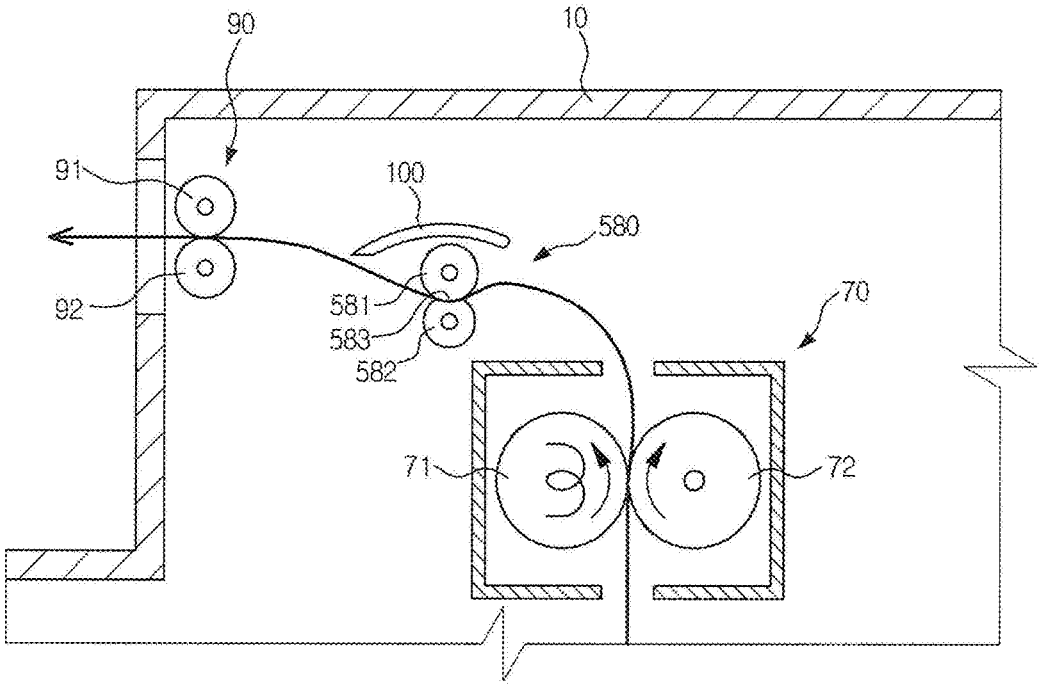
FIG. 8A and FIG. 8B are sectional views showing a decurl unit of an image forming apparatus according to yet other embodiments of the present disclosure.
Figure 8B:
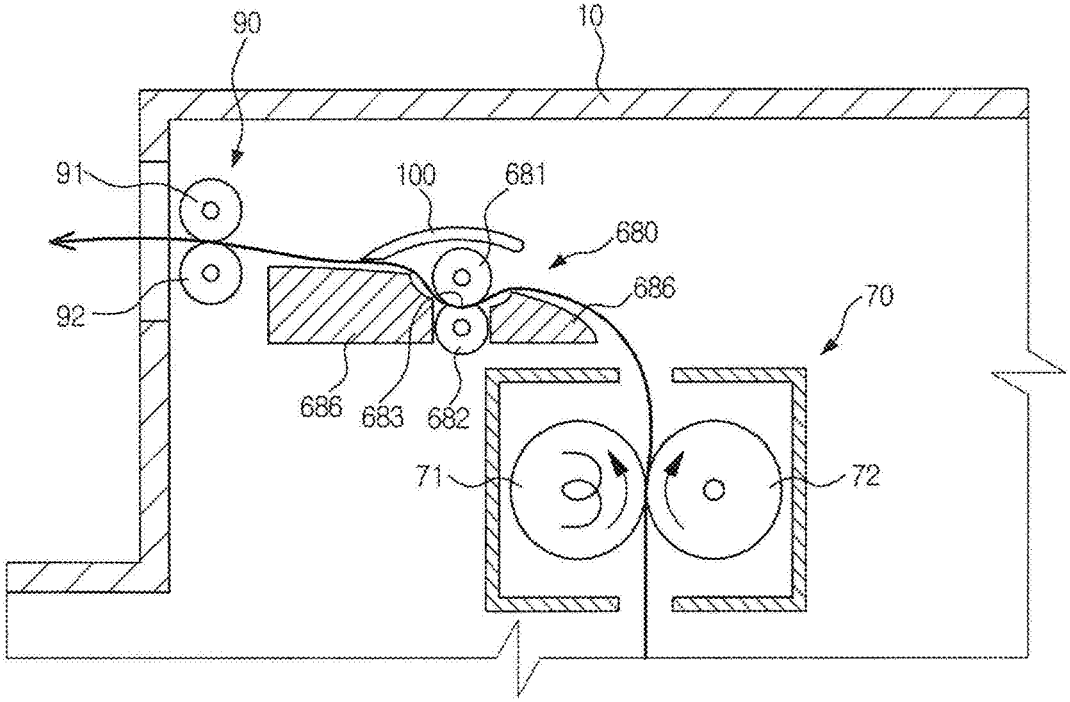

FIGS. 8A and 8B are sectional views showing a decurl unit of an image forming apparatus according to other alternative embodiments of the present invention.

Referring to FIG. 8A, a decurl unit 580 according to another embodiment of the present disclosure can include a first decurl roller 581 and a second decurl roller 582, each of which is configured to be rotated opposing the other. Outer circumferences of the first and the second decurl rollers 581 and 582 can be made of materials having different solidities. In one example, the outer circumference of the first decurl roller 581 can have a greater solidity than the outer circumference of the second decurl roller 582. A decurl path 583 having a predetermined curvature can be formed along the contact surface between the first and the second decurl rollers 581 and 582.

Referring to FIG. 8B, a decurl unit 680 according to yet another embodiment of the present disclosure can include first and second decurl rollers 681 and 682, each of which is configured to be rotated opposing the other, and a curved member 686 configured to extend on both sides of the first and second decurl rollers 681 and 682. The outer circumferences of the first and the second decurl rollers 681 and 682 can have different solidities. A decurl path 683 having a predetermined curvature can be formed along the contact surface between the first and the second decurl rollers 681 and 682. In such embodiment, the printing medium can enter the decurl unit 680 with more stability because the curved member 686 can be formed on each side of the first and second decurl rollers 681 and 682. Alternatively, in other embodiments, however, the curved member 686 can be formed on any one side of the first and second decurl rollers 681 and 682.

The decurl units according to the various embodiments have been described above only by way of examples. That is, the decurl unit according to the present disclosure is not limited to those specific embodiments and configurations.

Although a few embodiments of the present disclosure have been shown and described, it would be appreciated by those skilled in the art that changes may be made in these embodiments without departing from the principles and spirit of the disclosure. For example, the decurl unit and the guide unit may be applied to an inkjet image forming apparatus. The discharging device may comprise three or more roller members, not two as shown in several of the embodiments, and may also function as an auxiliary or secondary decurl unit.

What is claimed is:

1. An image forming apparatus, comprising:

a main body;

a photoconductive medium disposed in the main body;

a charging device configured to charge the photoconductive medium to a predetermined electrical potential;

a scanning device configured to scan the charged photoconductive medium with light corresponding to image data to form an electrostatic latent image on the photoconductive medium;

a developing device configured to form a visible image on the photoconductive medium by supplying developer to the photoconductive medium;

a transfer device configured to transfer the visible image from the photoconductive medium to a printing medium;

a fixing device configured to fix the visible image on the printing medium;

a decurl device configured to correct a curl of the printing medium, the decurl device comprising at least a first decurl roller, a second decurl roller rotatably disposed opposite the at least first decurl roller, with each of the first decurl roller and the second decurl roller being rotatably disposed in the decurl device, and at least one corresponding curved member having a predetermined curvature along which the medium travels, the at least one corresponding curved member including a first decurl portion and a second decurl portion forming a concave decurl path opposite a duplex printing guide device, the printing medium is delivered along the concave decurl path formed between at least the first and the second decurl roller and the first and second decurl portions, the first and the second decurl portions arranged flanking each other, or flanking each other and having at least the first decurl roller therebetween;

a discharging device configured to discharge the printing medium outside of the main body and to reverse a transport direction of the printing medium when a duplex printing is implemented; and the duplex printing guide device disposed between the fixing device and the discharging device, the duplex printing guide device being configured to guide the printing medium away from the decurl device when the transport direction of the printing medium is reversed for the duplex printing.

2. The image forming apparatus according to claim 1, wherein the duplex printing guide device is pivotably connected to the main body.

3. The image forming apparatus according to claim 2, wherein the duplex printing guide device is configured to pivot between a first position and a second position, when in the first position the duplex printing guide device being configured to allow the printing medium to be fed toward the discharging device, when in the second position the duplex printing guide device being configured to guide the printing medium around the decurl device when the printing medium is moving away from the discharging device and toward the transfer device.

4. The image forming apparatus according to claim 3, wherein an initial position of the duplex printing guide device is the second position, the duplex printing guide device being configured to pivot to the first position from the initial position when the printing medium is discharged from the decurl device, the duplex printing guide device being configured to return to the initial position from the first position by its own weight after the printing medium has passed through the decurl device.

5. The image forming apparatus according to claim 4, further comprising a member configured to elastically bias the duplex printing guide device toward the initial position.

6. The image forming apparatus according to claim 3, further comprising an actuator configured to pivot the duplex printing guide device.

7. The image forming apparatus according to claim 1, wherein the at least one corresponding curved member defines the concave decurl path having a predetermined curvature corresponding to a curvature of the at least first decurl roller.

8. The image forming apparatus according to claim 1, wherein the at least one corresponding curved member is configured to guide the printing medium between the first decurl roller and the second decurl roller of the decurl device.

9. The image forming apparatus according to claim 1, wherein the duplex printing guide device includes a curved portion.

10. The image forming apparatus according to claim 9, wherein the curved portion of the duplex printing guide device is configured to curve around the decurl device.

11. An image forming apparatus, comprising:

a main body;

a printing device disposed in the main body, the printing device being configured to form a visible image corresponding to image data on a printing medium;

a decurl device configured to correct a curl on the printing medium, the decurl device comprising at least a first decurl roller, a second decurl roller rotatably disposed opposite the at least first decurl roller, with each of the first decurl roller and the second decurl roller being rotatably disposed in the decurl device, and at least one corresponding curved member having a predetermined curvature along which the medium travels, the at least one corresponding curved member including a first and a second decurl portion forming a concave decurl path opposite a duplex printing guide device, the printing medium is delivered along the concave decurl path formed between at least the first decurl roller, the second decurl roller, and the first and second decurl portions, the first and the second decurl portions arranged flanking each other, or flanking each other and having at least the first decurl roller therebetween;

a discharging device configured to discharge the printing medium outside of the main body and to reverse a transport direction of the printing medium when a duplex printing is implemented; and the duplex printing guide device configured to guide the printing medium away from the decurl device.

12. The image forming apparatus according to claim 11, wherein the printing device comprises:

a photoconductive medium;

a charging device configured to charge the photoconductive medium to a predetermined electrical potential;

a scanning device configured to scan the charged photoconductive medium with light corresponding to image data to form an electrostatic latent image on the photoconductive medium;

a developing device configured to form a visible image on the photoconductive medium by supplying developer to the photoconductive medium;

a transfer device configured to transfer the visible image from the photoconductive medium to a printing medium; and a fixing device configured to fix the visible image on the printing medium.

13. The image forming apparatus according to claim 12, wherein the duplex printing guide device is configured pivot to thereby selectively prevent the printing medium from passing through the decurl device.

14. The image forming apparatus according to claim 13, wherein the duplex printing guide device is configured to pivot from a first position to a second position when the printing medium is discharged from the decurl device so as to allow the printing medium to discharge from the decurl device, the duplex printing guide device being configured to return to the first position from the second position by its own weight after the printing medium has discharged from the decurl device.

15. The image forming apparatus according to claim 11, wherein the at least one corresponding curved member defines the concave decurl path having a predetermined curvature corresponding to a curvature of the at least first decurl roller.

16. The image forming apparatus according to claim 11, wherein the duplex printing guide device includes a curved portion defining a curved path around the decurl device.

17. The image forming apparatus according to claim 11, further comprising: a discharging device configured to discharge the printing medium to a space outside of the main body, wherein the decurl device is configured such that the printing medium is conveyed from the printing device to the discharging device through the decurl device, the duplex printing guide device being configured such that the printing medium curves around the decurl device when the printing medium moves away from the discharging device.

18. An image forming apparatus, comprising:

a main body;

a photoconductive medium disposed in the main body;

a charging device configured to charge the photoconductive medium to a predetermined electrical potential;

a scanning device configured to scan the charged photoconductive medium with light corresponding to image data to form an electrostatic latent image;

a developing device configured to form a visible image on the photoconductive medium by supplying developer to the photoconductive medium having the electrostatic latent image;

a transfer device configured to transfer the visible image from the photoconductive medium to a printing medium;

a fixing device configured to fix the visible image on the printing medium;

a decurl device configured to correct a curl on the printing medium, the decurl device comprising at least a first decurl roller, a second decurl roller rotatably disposed opposite the at least first decurl roller, with each of the first decurl roller and the second decurl roller being rotatably disposed in the decurl device, and at least one corresponding curved member having a predetermined curvature along which the medium travels, the at least one corresponding curved member including a first and a second decurl portion forming a concave decurl path opposite a duplex printing guide device, the printing medium is delivered along the concave decurl path formed between at least the first decurl roller and the second decurl roller and the first and second decurl portions, the first and the second decurl portions arranged flanking each other, or flanking each other and having at least the first decurl roller therebetween;

a discharging device configured to discharge the printing medium to a space outside of the main body and to reverse a transport direction of the printing medium when a duplex printing is implemented; and the duplex printing guide device disposed between the decurl device and the discharging device, the duplex printing guide device being configured to prevent the printing medium from interacting with the decurl device when the transport direction of the printing medium is reversed for the duplex printing.

19. An image forming apparatus, comprising:

a first device configured to fix an image on a printing medium;

a second device configured to discharge the printing medium to a space outside the image forming apparatus and to reverse a transport direction of the printing medium when a duplex printing is implemented;

a third device disposed between the first device and the second device, the third device configured to remove at least a portion of a curl of the printing medium as the printing medium moves along a first direction away from the first device and toward the second device, the third device comprising at least a first decurl roller, a second decurl roller rotatably disposed opposite the at least first decurl roller, with each of the first decurl roller and the second decurl roller being rotatably disposed in the decurl device, and at least one corresponding curved member having a predetermined curvature along which the medium travels, the at least one corresponding curved member including a first and a second decurl portion forming a concave decurl path opposite a fourth device, the printing medium is delivered along the concave decurl path formed between at least the first decurl roller, the second decurl roller, and the first and second decurl portions, the first and the second decurl portions arranged flanking each other, or flanking each other and having at least the first decurl roller therebetween; and the fourth device configured to guide the printing medium away from the third device when the printing medium moves along a second direction away from the second device.

20. The image forming apparatus of claim 19, wherein: the fourth device is configured to have a first position and a second position, the fourth device being in the first position when the printing medium is moving through the third device in the first direction, the fourth device being in the second position when the printing medium is moving in the second direction.

21. The image forming apparatus of claim 20, wherein: the fourth device is configured to be in the first position or in the second position by pivoting about an end portion of the fourth device.

22. The image forming apparatus according to claim 1, wherein the concave decurl path is curved in a direction opposite to a direction of the curl.

* * * * *